US009593901B1

(12) United States Patent
Reed

(10) Patent No.: US 9,593,901 B1
(45) Date of Patent: Mar. 14, 2017

(54) RIFLE SUPPORT

(71) Applicant: Timothy Joseph Reed, Sandford, MI (US)

(72) Inventor: Timothy Joseph Reed, Sandford, MI (US)

( * ) Notice: Subject to any disclaimer, the term of this patent is extended or adjusted under 35 U.S.C. 154(b) by 0 days.

(21) Appl. No.: 15/099,680

(22) Filed: Apr. 15, 2016

(51) Int. Cl.
*F41C 27/00* (2006.01)
*F41A 23/04* (2006.01)
*F41C 33/00* (2006.01)

(52) U.S. Cl.
CPC ..... *F41A 23/04* (2013.01); *F41C 33/002* (2013.01)

(58) Field of Classification Search
CPC ..... F41A 23/04; F41C 33/002
See application file for complete search history.

(56) References Cited

U.S. PATENT DOCUMENTS 4,311,263 A * 1/1982 Bianchi ..... F41C 33/002 224/150
4,386,723 A * 6/1983 Mule ..... A45F 3/12 224/150
4,817,835 A * 4/1989 Tarr, Jr. ..... F41C 33/002 224/150
5,018,652 A 5/1991 Holtclaw
5,110,022 A 5/1992 Dvoroznak
5,433,288 A * 7/1995 James ..... A62C 33/04 182/3
5,642,584 A 7/1997 Riggenbach
8,322,067 B2 12/2012 Brood
2015/0076181 A1* 3/2015 Seuk ..... F41C 33/002 224/150

FOREIGN PATENT DOCUMENTS

DE 541430 C * 1/1932 ..... F41C 33/001
DE 1157965 B * 11/1963 ..... F41A 23/00
GB 2447076 A * 9/2008 ..... F41A 23/06

* cited by examiner

*Primary Examiner* — Gabriel Klein

(57) ABSTRACT

A rifle support that is used in a vertical axis to support a weapon when being fired. The support is flexible and allows the user to rest the support on their knee while resting the weapon on the rest. The flexible support allows the user to flex the support in any direction without moving the weapon from the rest.

1 Claim, 4 Drawing Sheets

RIFLE SUPPORT

BACKGROUND OF THE INVENTION

The use of slings as a rifle support is not new to the art. However, the use of sling as a rifle support that is firm, yet flexible, and used in the vertical axis, is. There are many examples of weapon slings being used in the longitudinal axis. U.S. Pat. No. 5,110,022 issued to Dvoroznak on May 5, 1992, entitled "Rifle Sling With Rifle Rest", teaches a rifle sling that includes an elongated central body portion having a pair of opposed protrusions defining therebetween a recess for receiving the rifle barrel. Ends of the rifle sling are connected to the rifle for carrying the rifle about the shoulder of the user. The body portion of the rifle sling provides a cushion as well as an aid in aiming the rifle when rested. This prior art teaches using the device in a longitudinal axis not in a vertical axis. In fact this prior art device cannot be used in a vertical orientation.

U.S. Pat. No. 5,018,652 issued to Holtzclaw on May 28, 1991, entitled, "Rifle Sling With Rifle Rest", teaches a rifle sling including an elongated central body portion having a pair of opposed protrusions defining therebetween a recess for receiving the rifle barrel. Ends of the rifle sling are connected to the rifle for carrying the rifle about the shoulder of a user. The body portion of the rifle sling provides a cushion as well as an aid in aiming the rifle, when rested on a support surface. This prior art teaches using the device in a longitudinal axis not in a vertical axis. In fact this prior art device cannot be used in the vertical orientation.

U.S. Pat. No. 5,642,584 issued to Riggenbach on Jul. 1, 1997, entitled, "Gun Sling", teaches a sling for use with a firearm. The sling includes a rigid body having a pivotable connector for one end, a releasable connector back end, and a firearm engagement section located between the front and the back ends. The rigid body is shaped to form a loop for receiving a user's shoulder once the front end is affixed to the hand grip section and the back end is affixed to the butt section. Furthermore, the rigid body is shaped such that as the back end of the rigid body is pivoted on a pivotable connector. The firearm engagement section is brought into contact with the firearm to allow the back end of the rigid body to be planted and thus support the firearm during firing. This prior art patent teaches a gun sling rest that is used in the longitudinal axis not the vertical axis.

U.S. Pat. No. 8,322,067 issued to Brood on Dec. 4, 2012, entitled, "Firearm Steady Rest", teaches a firearm steady rest which is incorporated as part of a rifle sling. The steady rest may be a single support arm or a folded support arm system deployed by a folding it outward to provide either a V-shaped support configuration or a U-shaped support configuration whereby the upwardly extending distal ends of the support engage and support the firearm therebetween. The steady rest may be grasped by the operator's forward extending hand to provide maximum steadying of the firearm for sighting and shooting. A gravity deploying bipod leg set is also provided which automatically locks into position when fully deployed by a gravity slide lock. This prior art device is used in the longitudinal axis and not in the vertical axis. It also depends upon the use of a bipod to fully steady the rest.

The present invention has greater utility over these and all other prior art devices because the prior art devices rely on the use of the longitudinal axis to rest the weapon. They are limited to a narrow strip to rest the gun upon. The present device allows the user to use the rest in the vertical axis and thus the rest and weapon can be flexed from side to side as well as front to back to acquire a moving target. The rest can be flexed while the weapon remains in place. The others rests cannot be used in this manner and thus have limitations not encountered when the present device is used.

THE INVENTION

The present invention is a support for a rifle. This support comprises a strap of predetermined length that has a first end and a second end. Each such end has attached thereto, a sling swivel connector.

The strap is located through a centered long axis opening in a flexible bar. The strap is slidable through the centered long opening of the flexible bar. The flexible bar has a length less than ½ of the predetermined length of the strap.

DETAILED DESCRIPTION OF THE DRAWINGS

Figure 1:
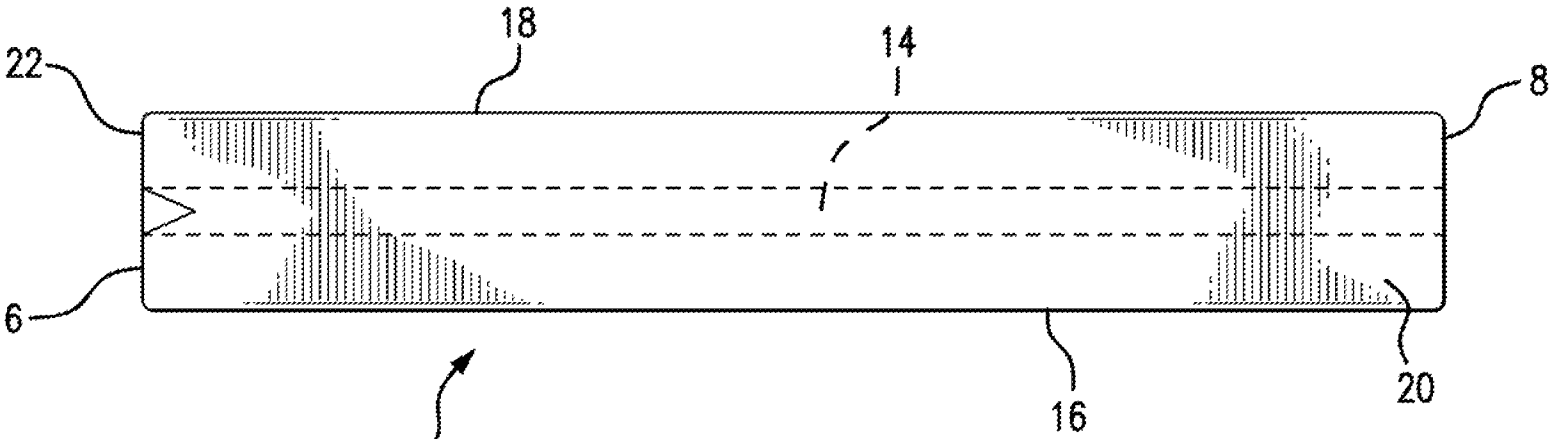
FIG. 1 shows a full side view of the rifle support.

FIG. 1 is a full side view of the rifle support 2. The rifle support 2 has a first end 6 and a second end 8. There is a center opening 14 that runs from the first end 6 through to the second end 8. The rifle support 2 also has a front 16 and a back 18. Also present is a first side 20 and a second side 22.

Figure 2:
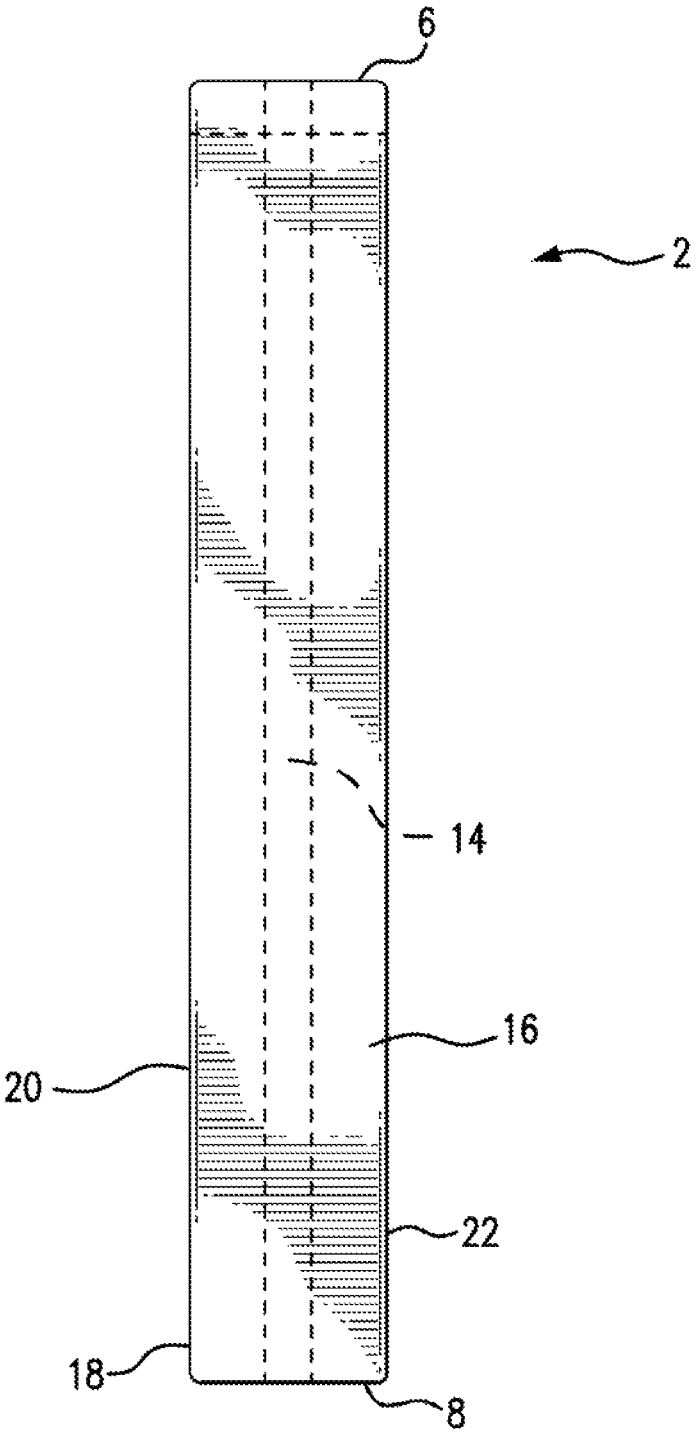
FIG. 2 shows a full frontal view of the rifle support.

FIG. 2 is a full frontal view of the rifle support 2. Here the rifle support 2 is in the vertical axis. The rifle support 2 has a first end 6 and a second end 8. There is a center opening 14 that runs from the first end 6 through to the second end 8. The rifle support 2 also has a front 16 and a back 18. Also present is a first side 20 and a second side 22. The rifle support 2 is flexible, meaning being able to be flexed out of linear alignment by the use of a human hand. The rifle support gets its flexibility by being manufactured of rubber elastomer, plastic, etc.

Figure 3:
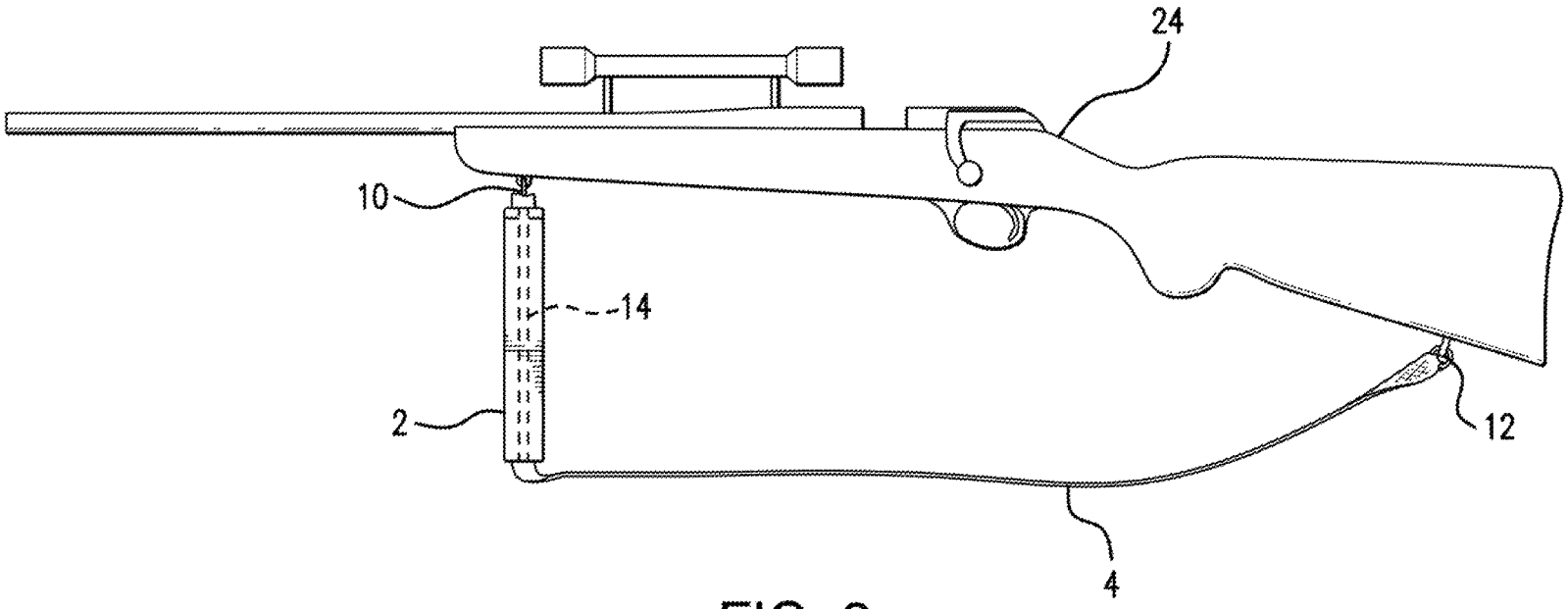
FIG. 3 shows a full side view of the rifle support.

FIG. 3 is a full side view of the rifle support 2. Here the rifle 24 has the rifle support 2 attached to the arm stock 26 and the butt stock 28. The connections are made through the swivel connecters 10 and 12 and attached to a sling or strap 4. Swivel connectors 10 and 12 are a fastening device that allows the weapon that is fastened to the sling to turn around freely upon it. Such a device consisting of two parts, each of which turns around independently, as a compound link of a chain, one part of which turns freely in the other by means of a headed pin or the like. In this case the pivoted support allowing the gun to turn around in a horizontal plane.

The strap 4 has a predetermined length of 30 to 45 inches. It has been discovered that the user can place the second end 8 of the rifle support on their knee and hold the rifle support 2 with the free hand as the rifle 24 rests upon the first end 6 of the support, resting the rifle 24. The utility of the present invention is greatly increased by the user's ability to flex the rifle support 2 in aid of sighting the rifle upon the target.

Figure 4:
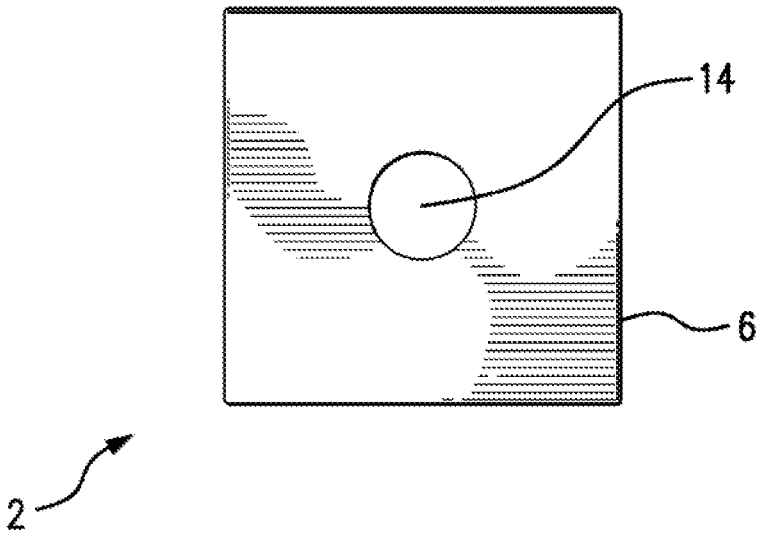
FIG. 4 shows a full end view of the rifle support.

FIG. 4 shows a full end view of the rifle support 2. This shows the opening 14 that runs from the first end 6 through to the second end 8.

What is claimed is:

1. A support for a rifle, said support comprising:

i. a strap of predetermined length having a first, end and a second end;

ii. each such said end having attached thereto, a sling swivel connector;

iii. said strap being located through a round centered long axis opening in a flexible bar, said strap being slidable through said centered long axis opening;

iv. said flexible bar having a length less than one-half of the predetermined length of said strap.

* * * * *